US006983035B2

(12) United States Patent
Price et al.

(10) Patent No.: US 6,983,035 B2
(45) Date of Patent: Jan. 3, 2006

(54) EXTENDED MULTI-SPOT COMPUTED TOMOGRAPHY X-RAY SOURCE

(75) Inventors: John Scott Price, Wauwatosa, WI (US); Wayne Frederick Block, Sussex, WI (US); Mark Vermilyea, Niskayuna, NY (US)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 204 days.

(21) Appl. No.: 10/669,613

(22) Filed: Sep. 24, 2003

(65) Prior Publication Data

US 2005/0063514 A1 Mar. 24, 2005

(51) Int. Cl.
*H01J 35/08* (2006.01)

(52) U.S. Cl. ..... 378/124; 378/4; 378/144

(58) Field of Classification Search ..... 378/124, 378/125, 137, 4–20, 143, 144

See application file for complete search history.

(56) References Cited

U.S. PATENT DOCUMENTS

| | | | | |
|---|---|---|---|---|
| 4,250,425 | A * | 2/1981 | Gabbay et al. | 378/125 |
| 4,531,226 | A | 7/1985 | Peschmann | |
| 5,467,377 | A * | 11/1995 | Dawson | 378/19 |
| 6,125,167 | A * | 9/2000 | Morgan | 378/124 |
| 2002/0094064 | A1 | 7/2002 | Zhou et al. | |

* cited by examiner

*Primary Examiner*—Craig E. Church
(74) *Attorney, Agent, or Firm*—Dougherty Clements; Christopher L. Bernard; Peter J. Vogel

(57) ABSTRACT

Systems and methods for obtaining multi-slice images having a total thickness of up to about 160 mm or more in a single gantry rotation in computed tomography or volume computed tomography are described. One embodiment comprises an extended, multi-spot x-ray source for computed tomography or volume computed tomography imaging, comprising: an electron gun capable of producing a plurality of electron beams, each electron beam focused at a predetermined distance and aimed in a predetermined direction; and a plurality of targets positioned to receive the electron beams and generate x-rays in response thereto, each target comprising a predetermined focal spot thereon, wherein each electron beam is synchronized to strike, at an appropriate time, a predetermined target comprising a predetermined focal spot thereon.

25 Claims, 5 Drawing Sheets

EXTENDED MULTI-SPOT COMPUTED TOMOGRAPHY X-RAY SOURCE

FIELD OF THE INVENTION

The present invention relates generally to computed tomography (CT) imaging and volume computed tomography (VCT) imaging. More specifically, the present invention relates to multi-spot x-ray sources for CT imaging. Even more specifically, the present invention relates to a stand-alone, self-contained electron gun, having electron beams focusable at different distances, which impinge on multiple targets to generate near-linear multi-spot x-rays for CT and VCT imaging.

BACKGROUND OF THE INVENTION

Computed tomography (CT), sometimes called computed axial tomography (CAT) or CAT scan, and volume computed tomography (VCT), use special x-ray equipment to obtain image data from different angles around a person's body, and then use computer processing of the data to create a two-dimensional cross-sectional image (i.e., slice) or three-dimensional image of the body tissues and organs that were scanned. CT and VCT imaging are particularly useful because they can show a combination of several different types of tissue (i.e., heart, lungs, stomach, colon, kidneys, liver, bone, blood vessels, muscles, etc.) with high spatial resolution and a great deal of clarity and contrast. Radiologists can interpret CT and VCT images to diagnose various injuries and illnesses, such as cardiovascular disease, trauma, cancer, and musculoskeletal disorders. CT and VCT images can also be used to aid in minimally invasive surgeries, and to allow for accurate planning and pinpointing of tumors for radiation treatment, among other things.

CT and VCT imaging allow structures within a body to be identified and delineated without superimposing other structures on the images created thereby. In a typical conventional CT or VCT imaging system, an x-ray source emits a fan-shaped x-ray beam that is collimated to lie within an X-Y plane of a Cartesian coordinate system, generally referred to as the "imaging plane." The x-ray beam passes through a section of the object being imaged, typically a patient. After passing through the object and being attenuated thereby, the x-ray beam impinges upon an array of radiation detector elements. The intensity of the attenuated x-ray beam radiation that is received by each detector element varies since different parts of the body absorb and attenuate the x-rays differently. Each detector element in the array produces a separate electrical signal that is a measurement of the x-ray beam's attenuation at each detector element. The attenuation measurements from all the detector elements are acquired separately, and are then combined to produce an image transmission profile.

Currently, x-ray sources for CT and VCT are limited to fairly narrow "slices" for each revolution of the gantry because of the well-understood "cone-beam artifact" problem, in which the "edges" of the cone-like x-ray beam that emerges from a point source cannot produce enough attenuation data, thereby resulting in portions of the imaged object not being imaged at all. It would be desirable, particularly for VCT, to have an extended or "linear" x-ray source to eliminate or minimize the cone-beam artifact problem. That would make it possible to obtain CT or VCT scans that cover an entire organ in a single scan or revolution of the gantry. For example, while existing CT and VCT imaging systems and methods allow multi-slice images, having a total thickness of about 10–40 mm, to be obtained in a single gantry rotation, it would be desirable to have CT and VCT imaging systems and methods that allowed multi-slice images having a total thickness as thick as 80–160 mm or thicker to be obtained in a single gantry rotation. However, improved CT and VCT imaging systems and methods are needed in order for thicker multi-slice images to be realized.

Since existing CT and VCT imaging systems and methods have many drawbacks, it would be desirable to have improved CT and VCT imaging systems and methods that lack such restrictions. This invention provides a single, near-linear, multi-spot x-ray source that utilizes multiple x-ray targets having varying focal spots thereon so as to improve the imaging data around the edges of the object being imaged, thereby allowing thicker multi-slice images to be obtained than currently possible.

SUMMARY OF THE INVENTION

Accordingly, the above-identified shortcomings of existing CT and VCT imaging systems and methods are overcome by embodiments of the present invention, which relates to a single, near-linear, multi-spot x-ray source comprising multiple targets that have varying focal spots thereon. Embodiments of this invention allow thicker multi-slice images (up to about 80–160 mm thick or thicker) to be obtained with each gantry rotation than currently possible with existing CT and VCT imaging systems.

Embodiments of this invention comprise systems and methods for obtaining thick total volume slices (i.e., up to about 160 mm or thicker) in a single gantry rotation in computed tomography or volume computed tomography. Embodiments of this invention comprise an extended, multi-spot x-ray source for computed tomography and/or volume computed tomography imaging. This x-ray source comprises: an electron gun capable of producing a plurality of electron beams, each electron beam focused at a predetermined distance and aimed in a predetermined direction; and a plurality of targets positioned to receive the electron beams and generate x-rays in response thereto, each target comprising a predetermined focal spot thereon, wherein each electron beam is synchronized to strike, at an appropriate time, a predetermined target comprising a predetermined focal spot thereon.

The plurality of targets rotate about an axis of rotation. Each target comprises a different focal spot thereon, each electron beam is focused at a different distance, and each electron beam is aimed in a different direction. Each electron beam also strikes a different target having the appropriate focal spot thereon. A single electron beam, focused at a predetermined distance, strikes only one target, comprising a matching predetermined focal spot thereon, at a time.

At least one target is designed to let electron beams pass therethrough and strike another target at predetermined intervals. At least one target may comprise a cut-out section that allows electron beams to pass therethrough and strike another target at predetermined intervals.

The x-ray source may comprise a sensing device for identifying a rotational position of the targets. The sensing device may comprise: a magnetic material disposed on a rotor; and a magnetic pick-up device disposed in close proximity to the magnetic material, wherein when the rotor spins around its axis of rotation, the magnetic pick-up device obtains a voltage or current signal as the magnetic material passes thereby, and then the magnetic pick-up device transmits an appropriately treated and amplified signal to the electron gun to change electron beam focusing parameters and/or to make deflection corrections.

Adjusting a focal bias voltage or an accelerating voltage placed on the electron gun focuses at least one electron beam, and/or changes the electron beam properties. A total volume slice (i.e., a total thickness of the multi-slice images) of up to about 80 mm to about 160 mm thick or thicker can be obtained in a single gantry rotation.

Embodiments of this invention also comprise a computed tomography or volume computed tomography imaging system. These systems comprise an extended, multi-spot x-ray source. This x-ray source comprises: an electron gun capable of producing a plurality of electron beams, each electron beam focused at a predetermined distance and aimed in a predetermined direction; and a plurality of targets positioned to receive the electron beams and generate x-rays in response thereto, each target comprising a predetermined focal spot thereon, wherein each electron beam is synchronized to strike, at an appropriate time, a predetermined target comprising a predetermined focal spot thereon; and an x-ray detector, wherein the x-ray source projects a multi-spot beam of x-rays towards the x-ray detector, the x-ray detector detects the x-rays, and an image is created therefrom.

Further features, aspects and advantages of the present invention will be more readily apparent to those skilled in the art during the course of the following description, wherein references are made to the accompanying figures which illustrate some preferred forms of the present invention, and wherein like characters of reference designate like parts throughout the drawings.

DESCRIPTION OF THE DRAWINGS

The systems and methods of the present invention are described herein below with reference to various figures, in which.

DETAILED DESCRIPTION OF THE INVENTION

For the purposes of promoting an understanding of the invention, reference will now be made to some preferred embodiments of the present invention as illustrated in FIGS. 1–5 and specific language used to describe the same. The terminology used herein is for the purpose of description, not limitation. Specific structural and functional details disclosed herein are not to be interpreted as limiting, but merely as a basis for the claims as a representative basis for teaching one skilled in the art to variously employ the present invention. Any modifications or variations in the depicted support structures and methods, and such further applications of the principles of the invention as illustrated herein, as would normally occur to one skilled in the art, are considered to be within the spirit and scope of this invention.

Figure 1:
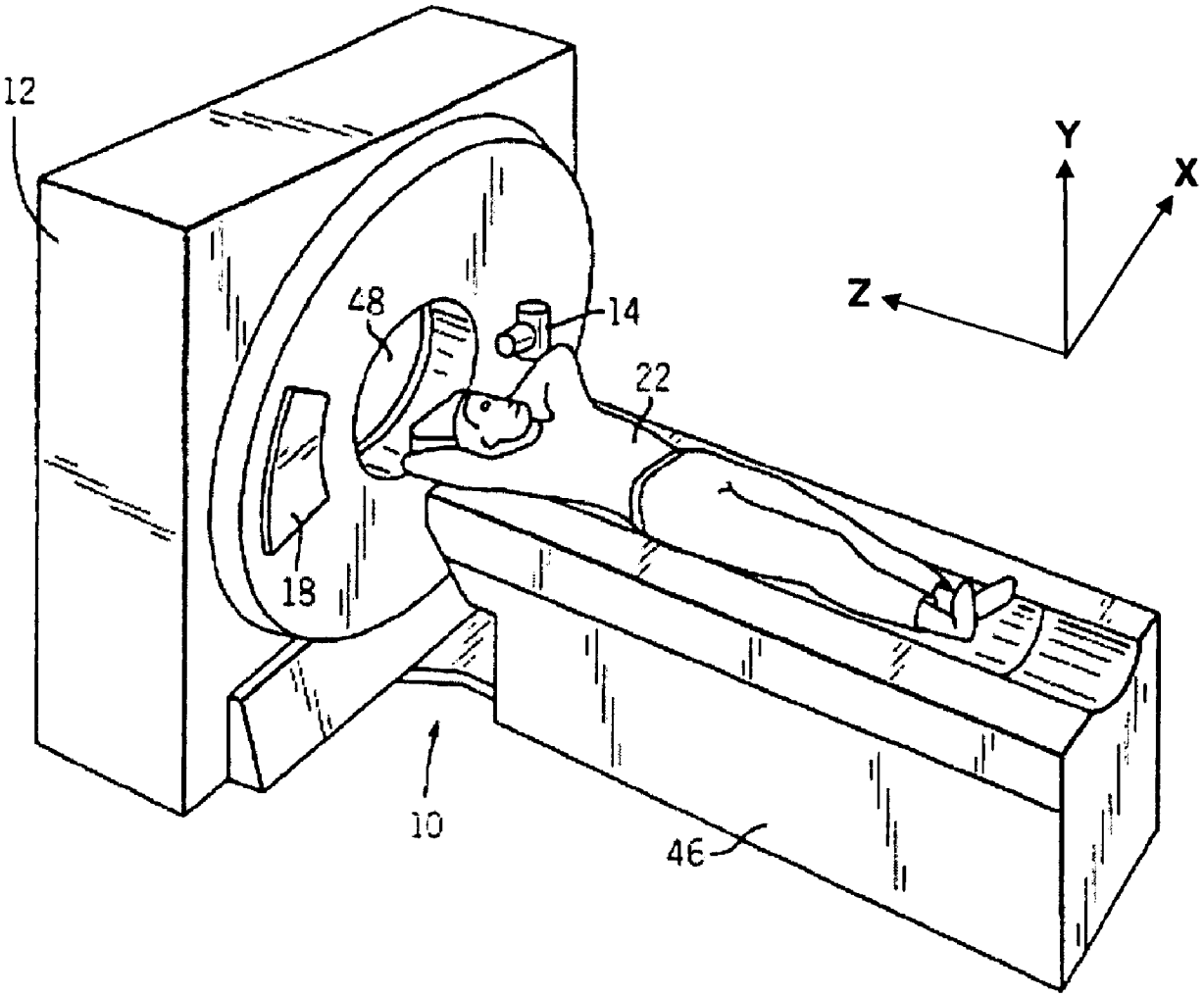
FIG. 1 is a schematic drawing showing one embodiment of a CT imaging system that may be utilized in embodiments of this invention.

This invention relates to systems and methods for minimizing or eliminating the cone-beam artifact problem in CT images, particularly VCT images, to allow thicker multi-slice images to be obtained with each gantry rotation. Referring now to FIG. 1, there is shown a schematic diagram showing an exemplary CT imaging system 10 that may be utilized in embodiments of this invention. Such systems generally comprise a gantry 12, a gantry opening 48, and a table 46 upon which a patient 22 may lie. Gantry 12 comprises an x-ray source 14 that projects a beam of x-rays 16 toward an array of detector elements 18. During operation, gantry 12 rotates about a center of rotation 24 to obtain an image of one or more "slices" of an area of interest in a patient 22. Generally, the array of detector elements 18 comprises a plurality of individual detector elements 20 that are arranged in a side-by-side manner in the form of an arc that is essentially centered on x-ray source 14. In multi-slice imaging systems, parallel rows of arrays of detector elements 18 can be arranged so that each row of detectors can be used to simultaneously generate multiple thin slice images through patient 22 in the X-Y plane. Each detector element in the array of detector elements 18 senses and detects the x-rays 16 that pass through an object, such as patient 22, and then an image is created therefrom. While this figure shows the x-ray source 14 and the array of detector elements 18 aligned in the X-Y plane, some CT imaging systems may align the x-ray source 14 and the array of detector elements 22 differently, without deviating from the spirit and scope of this invention.

Figure 2:
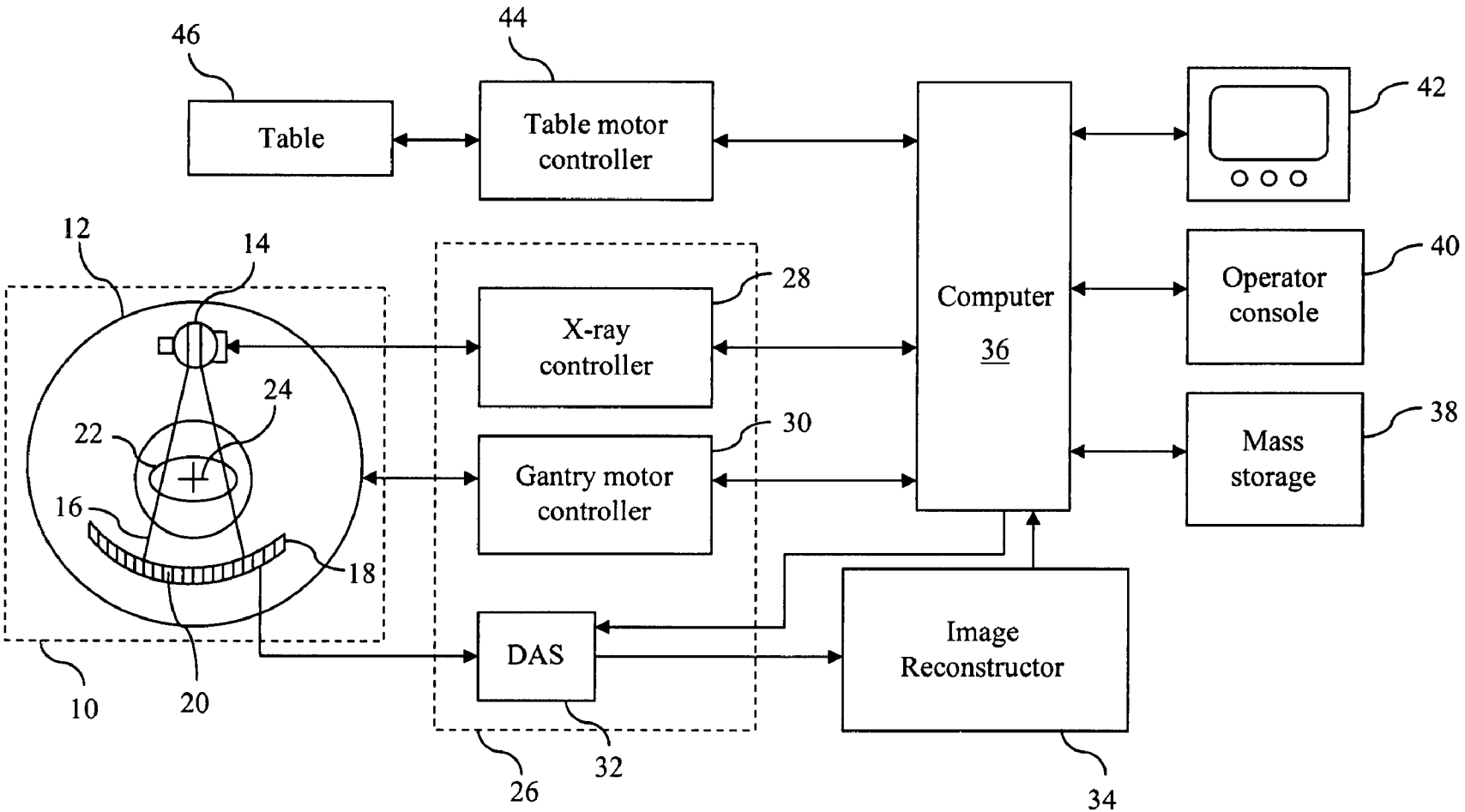
FIG. 2 is a schematic drawing showing the architecture of the CT imaging system shown in FIG. 1.

Referring now to FIG. 2, there is shown a schematic diagram showing the architecture of the CT imaging system shown in FIG. 1. The rotation of gantry 12 and the operation of x-ray source 14 are governed by a control mechanism 26 of CT imaging system 10. Control mechanism 26 includes an x-ray controller 28 that provides power and timing signals to x-ray source 14, and a gantry motor controller 30 that controls the rotational speed and position of gantry 12. A data acquisition system (DAS) 32 in control mechanism 26 samples analog data from the individual detector elements 20, and converts that analog data to digital signals for subsequent processing in accordance with the methods and systems of this invention. An image reconstructor 34 receives the sampled and digitized x-ray data from DAS 32 and performs high speed image reconstruction thereon. The reconstructed image is then applied as input to a computer 36, which can store the image in a mass storage device 38. Computer 36 may also retrieve stored images from the mass storage device 38 for later viewing.

Computer 36 may also receive commands and scanning parameters from an operator via an operator console 40, which may comprise a keyboard, touchpad, or other suitable input device. An associated cathode ray tube display 42 (or other suitable display) may allow the operator to view the reconstructed image and other data from computer 36. The operator supplied commands and parameters may be used by computer 36 to provide control signals and information to DAS 32, x-ray controller 28 and gantry motor controller 30. Additionally, computer 36 may operate a table motor controller 44 which can control a motorized table 46, thereby allowing the patient 22 to be properly positioned within gantry 12 or moved therethrough. For example, table 46 may move portions of patient 22 through gantry opening 48 in the Z-direction.

Embodiments of the present invention may make use of software or firmware running on computer 36. A mouse or pointing device may be employed to facilitate the entry of data and/or image locations. Other embodiments of this invention may utilize a general purpose computer or workstation having a memory and/or printing capability for storing or printing images. Suitable memory devices are well known and include, but are not limited to, RAM, diskettes, hard drives and optical media. Embodiments using such stand-alone computers or workstations may receive data from CT imaging system 10 via conventional electronic storage media or via a conventional communications link, and images may then be reconstructed therefrom.

Generally, x-ray sources for CT and VCT comprise single focal spot x-ray tubes 14 mounted on gantry 12. Such x-ray sources produce a single fan-like x-ray beam that is aimed at the array of detector elements 18. However, there are drawbacks for such single focal spot x-ray sources: (1) such x-ray sources limit the image that can be obtained to fairly narrow "slices" per each gantry revolution (i.e., slices having a total combined thickness of about 10–40 mm); and (2) such sources also lead to the cone-beam artifact problem, in which there is not enough data to be detected on the "edges" of the cone-like beam emerging from such point sources. Therefore, in order to increase the z-axis coverage, an extended x-ray source is needed to produce a linear or near-linear x-ray source effect so that sufficient information for large organ scans can be gathered with a single gantry revolution. While using multiple x-ray sources arranged in a linear fashion is one possible solution, it is a very expensive and cumbersome solution to the problem, and is therefore not very practical. This invention, on the other hand, provides a much less expensive and less cumbersome solution to the problem, making it ideal for extending the x-ray source in the z-direction. Additionally, this invention allows multi-slice images as large as 80–160 mm thick, or sometimes even thicker, to be obtained in a single gantry rotation.

Figure 3:
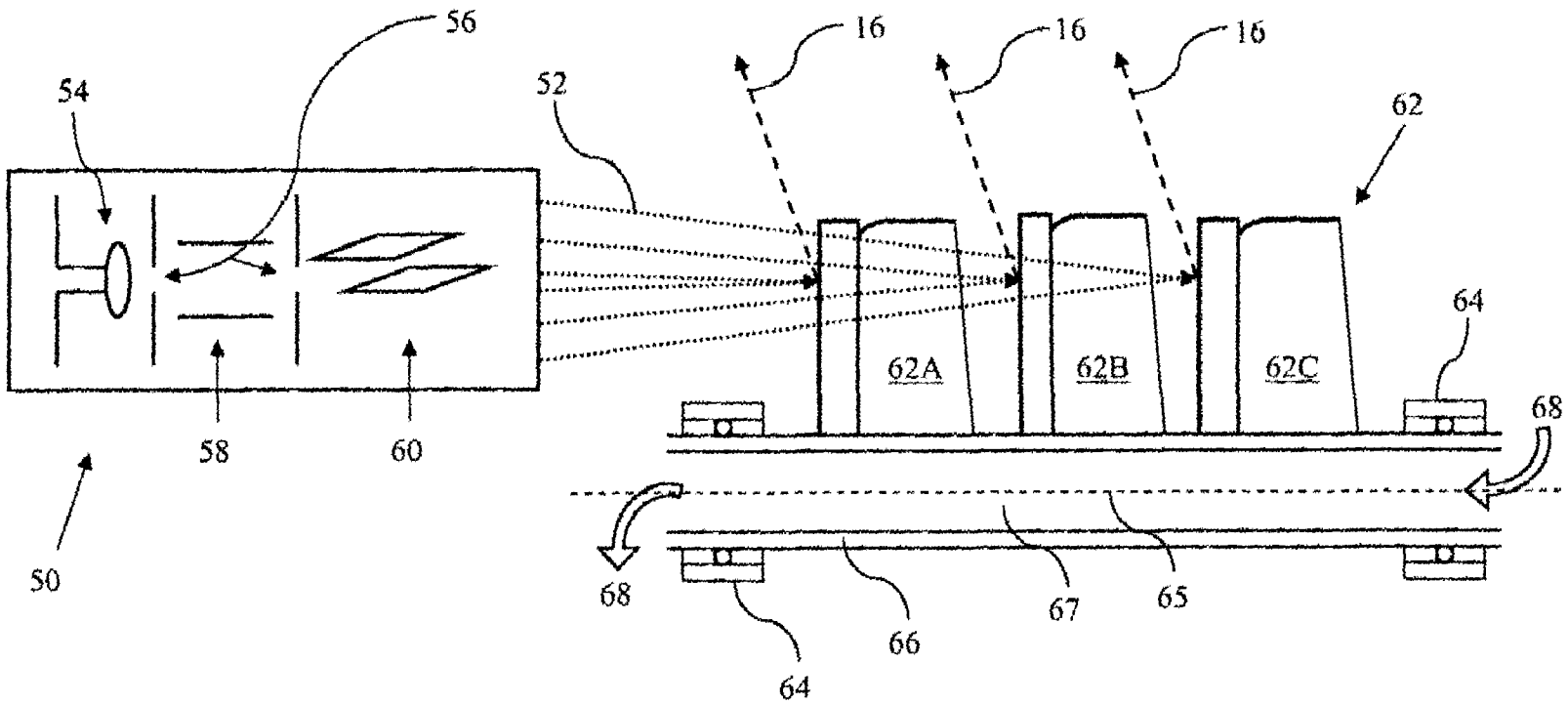
FIG. 3 is a schematic diagram showing an embodiment of a self-contained electron gun that produces an electron beam that can be sequentially focused at different distances, wherein the electron beam sequentially strikes a different target having a different focal spot thereon, which yields a near-linear multi-spot x-ray source useful for CT and VCT imaging.

Referring now to FIG. 3, there is shown a schematic diagram showing an embodiment of this invention comprising a single self-contained electron gun 50 that produces an electron beam 52 that can be sequentially focused at different distances, wherein the electron beam 52 sequentially strikes a different target 62A, 62B, 62C having a different focal spot thereon. While there are three targets 62A, 62B, 62C shown in this embodiment, this is in no way meant to be limiting on this invention. In fact, other embodiments of this invention may comprise other numbers of targets, such as anywhere from 2–6 different targets 62, with each target 62 having a different focal spot thereon. Also, depending on the application, even more than 6 targets could be used, if desired.

This invention comprises a single, self-contained electron gun 50 that produces focused electron beams 52 independent of most tube geometry features. This electron gun 50 may comprise a General Electric Imatron electron gun. As shown in FIG. 3, the electron gun 50 comprises an electron source 54, apertures 56, accelerating and/or focusing electrodes 58, and steering electrodes 60. This electron gun 50 produces focused electron beams 52, each having a different focal length and direction. The electron beams 52 produced hereby can be focused, and the electron beam properties can be changed rapidly, by adjusting the focal bias voltages placed on parts inside the electron gun 50. By focusing in this manner, the electron gun 50 is free from the focusing effect of the tube geometry, and can therefore be controlled by simply changing the accelerating and bias voltages within the electron gun 50 structure. In embodiments, the electron gun 50 may be aimed at a stack of slotted targets 62 that are mounted on a straddle support 64 for ideal gantry movement load distribution. The targets 62 may comprise molybdenum (Mo), and the targets 62 may be mounted on a shaft 66 comprising tungsten (W) alloyed with about 5–10% rhenium (Re). The targets 62 and shaft 66 may also comprise any other suitable materials. The electron gun 50 may be isolated from nearby objects at ground potential with high-density alumina or other insulation material suitable for high voltage electrostatic isolation.

In embodiments, the electron gun 50 may be aimed roughly parallel to the axis of rotation 65 of a stacked ensemble of multiple targets 62 that form an anode having several different focal spots. X-rays 16 may emerge from the targets 62 at a proper range of angles between the cut-off due to the heel effect, and that angle plus the usable angle imposed by cone-beam artifacts and reconstruction limits. Several targets 62A, 62B, 62C may be mounted on shaft 66, which is mounted on a straddle support 64. The straddle support 64 may comprise one or more sets of ball bearing assemblies, and ideally, distributes the mechanical load over the ball bearing assemblies to improve the bearing operation and yield longer bearing life. The shaft 66, on which the targets are stacked and mounted, may comprise a hollow channel 67 therein so that liquid coolant, water or other suitable substance 68 can circulate freely therein to cool the targets 62A, 62B, 62C. Since the targets 62A, 62B, 62C and anode structure are at ground potential, cooling fluid 68 may be supplied thereto via pumps and hoses/lines. This grounded target design is a simplified high efficiency motor (HEM) design, since a close distance between the rotor (enclosed in a vacuum vessel) and the stator (in atmosphere or in oil or other cooling fluid) provides close magnetic coupling between the two motor elements.

Figure 4:
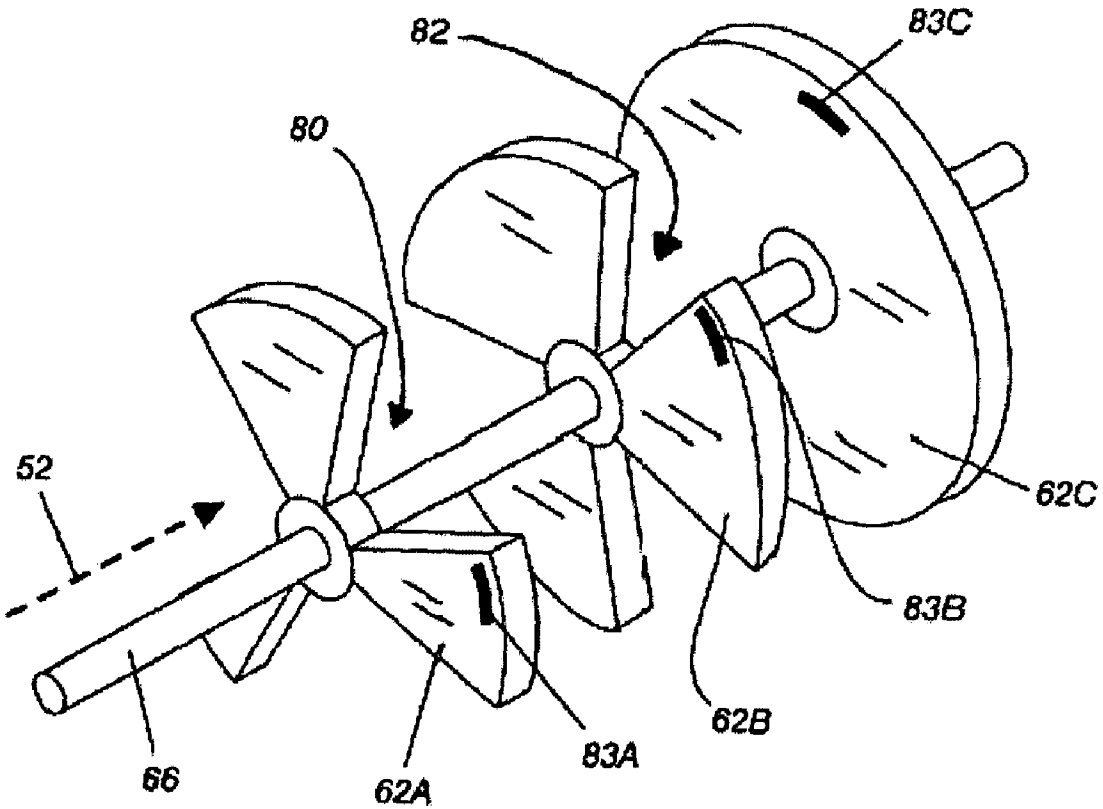
FIG. 4 is a schematic diagram showing multiple targets, some notched, each having a different focal spot thereon, as utilized in embodiments of this invention.

Referring now to FIG. 4, there is shown a schematic diagram showing multiple targets 62A, 62B, 62C, some notched, each having a different focal spot thereon, as utilized in embodiments of this invention. As shown herein, the first target 62A comprises large notches 80, while the second target 62B comprises small notches 82, and the third target 62C is not notched at all. The large notches 80 in the first target 62A allow the electron beam 52 to pass through the first target 62A and either strike or pass through the second target 62B, as appropriate, while the small notches 82 in the second target 62B allow the electron beam 52 to pass through the second target 62B and strike the third target 62C. In embodiments, the third target 62C comprises a focal spot 83C thereon from about 0–40°, the second target 62B comprises a focal spot 83B thereon from about 40–80°, and the first target 62A comprises a focal spot 83A thereon from about 80–120°. The large notches 80 in the first target 62A are shown here in this embodiment as comprising cut-out sections from about 0–80°, 120–200°, and 240–320°, while the small notches 82 in the second target 62B are shown here as comprising cut-out sections from about 0–40°, 120–160°, and 240–280°. While the notches 80, 82 herein are shown as pie-shaped cut-outs, various other cut-outs are possible without deviating from the spirit and scope of this invention. For example, the notches could comprise windows cut-out from around the periphery of the targets 62, or could comprise any other suitable shape or design that allows the electron beam 52 to pass through the target 62 and strike or pass through the next target 62. Additionally, while each target 62A, 62B herein is shown having three notches therein 80, 82 respectively, numerous other cut-out/notching arrangements are possible within the scope of this invention.

The electron gun 50 is designed to allow the focal spot of the electron beam 52 that is being emitted at a specific time to be synchronized with the target 62 comprising that particular focal spot thereon. For example, while the targets 62A, 62B, 62C are rotating with shaft 66, there are predetermined times when the third target 62C is to be struck by the electron beam 52 (and accordingly, the electron beam 52 passes through the first target 62A and the second target 62B at that time), then when the second target 62B is to be struck by the electron beam 52 (and accordingly, the electron beam 52 passes through the first target 62A at that time), and then when the first target 62A is to be struck by the electron beam 52. Since all three targets 62A, 62B, 62C have different focal spots 83 thereon, the electron beam focus is controlled so that the electron gun 50 emits an electron beam 52 having the appropriate focal length for the given target it is to strike at that time.

Figure 5:
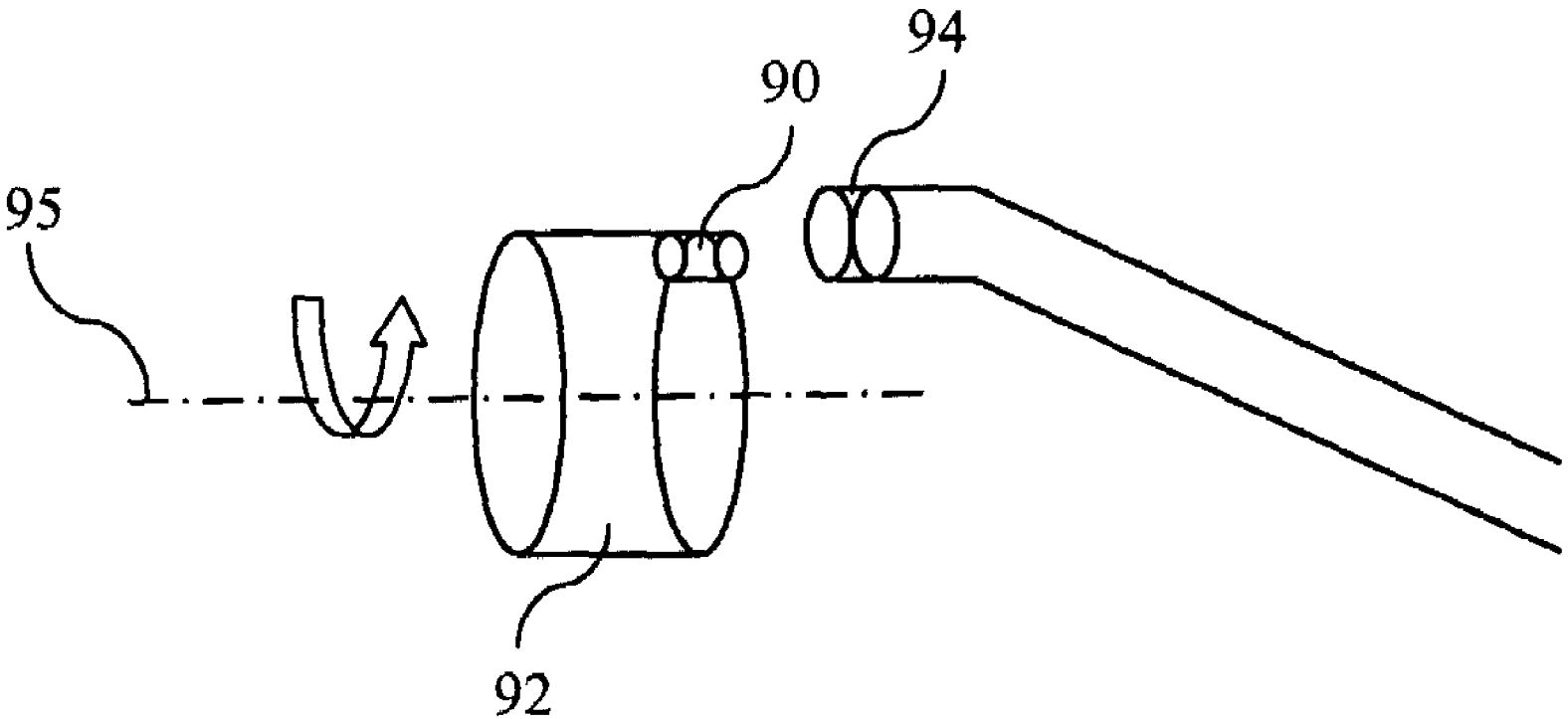
FIG. 5 is a schematic diagram showing a sensing coil that produces a rotation-angle-dependent signal, which is used to trigger changes in electron beam focusing in the electron gun from one target to the next, as utilized in embodiments of this invention.

In embodiments of this invention, the electron gun 50 is controlled by obtaining a signal from a magnetic pick-up device such as the one shown in FIG. 5, which functions as an odometer or tachometer and produces a rotational phase-determined signal. As shown herein in this non-limiting embodiment, a sensing device for identifying the rotational position of the targets comprises a slug or pin of magnetic material 90 embedded in the rotor 92, and a magnetic pick-up device 94 disposed in close proximity thereto. As the rotor 92 spins around its axis of rotation 95, the magnetic pick-up device 94 (shown here as being a B-flux sensing coil), obtains a voltage or current signal each time the magnetic slug 90 passes the sensing coil 94. An appropriately treated and amplified signal can then be transmitted to the electron gun 50 to change the electron beam focusing parameters and, if necessary, to make any deflection corrections that may be needed to optimize the performance of this multi-spot x-ray source. In this manner, an entire revolution of the rotor 92 can be accounted for, and the focal length of the electron beam 52 can be adjusted and controlled so that the electron gun 50 emits an electron beam 52 having the appropriate focal length, depending upon which target 62A, 62B, 62C the electron beam 52 is supposed to strike at a particular time.

For example, initially, and while the rotating target assembly has an angular orientation of about 0–40°, the electron gun 50 may emit an electron beam 52 that strikes the third target 62C. Then, after a predetermined period of time, and while the rotating target assembly has an angular orientation of about 40–80°, the electron gun focusing parameters could change and cause the electron gun 50 to emit an electron beam 52 that strikes the second target 62B. Then, after another predetermined period of time, and while the rotating target assembly has an angular orientation of about 80–120°, the electron gun focusing parameters could change again and cause the electron gun 50 to emit an electron beam 52 that strikes the first target 62A. This can continue in 40° increments until the rotor 92 has made one complete revolution, after which the cycle may start over again from the beginning, with the electron gun 50 emitting an electron beam 52 that strikes the third target 62C, then the second target 62B, then the first target 62A, etc. While 40° increments have been described herein, this is in no way meant to be limiting on this invention as other angular increments could clearly be used too.

The bias voltages of the electron gun 50 that determine the focal length of the electron beam may be established in 10's of μseconds. This is fast enough to accomplish the necessary switching of the focusing parameters since the targets 62A, 62B, 62C rotate at about 120 Hz or 8.0 msec/revolution, which is approximately 20 μsec/degree. The electron guns 50 of this invention may allow the electron beam source to be handled as a complete sub-assembly, thereby making it easier to replace, align, design and improve the electron beam source independent of the remaining x-ray tube insert geometry.

As described above, this invention provides an extended, near-linear multi-spot x-ray source that allows thicker multi-slice images to be obtained than currently possible with existing CT and/or VCT imaging systems. Advantageously, this invention utilizes a combination of known target and x-ray source technology to yield a near-linear x-ray source, which can ideally be utilized in CT and/or VCT imaging systems. This invention comprises a single self-contained electron gun that produces focused electron beams that are independent of most tube geometry features. These electron beams have different focal lengths, with each beam being designed to strike a different target, which creates a near-linear, multi-spot x-ray source. The targets are designed to allow the electron beams to pass therethrough when required, so that more distant targets can be struck by the electron beam. The multiple targets in this invention allow multi-spot x-rays to be generated from a single source, and the multi-spot x-ray source of this invention allows a number of previously inaccessible diagnostic techniques to be realized, of which whole organ scanning in a single CT or VCT scan is only one. Many other advantages will also be apparent to those skilled in the relevant art.

Various embodiments of this invention have been described in fulfillment of the various needs that the invention meets. It should be recognized that these embodiments are merely illustrative of the principles of various embodiments of the present invention. Numerous modifications and adaptations thereof will be apparent to those skilled in the art without departing from the spirit and scope of the present invention. For example, while the embodiments shown and described herein utilized three targets, it will be appreciated by those skilled in the art that this invention may comprise other numbers of targets without deviating from the spirit and scope of this invention, and all such variations are intended to be covered herein. Additionally, while pie-shaped cut-out notches were described herein as a means of letting the electron beams pass through a particular target, numerous other designs are possible, and are also intended to be covered herein. Thus, it is intended that the present invention cover all suitable modifications and variations as come within the scope of the appended claims and their equivalents.

What is claimed is:

1. An extended multi-spot x-ray source for computed tomography or volume computed tomography imaging, comprising:

an electron gun for producing a plurality of electron beams, each electron beam focused at a predetermined distance and aimed in a predetermined direction;

a plurality of targets positioned to receive the electron beams and generate x-rays in response thereto, each target comprising a predetermined focal spot thereon, and at least one target configured to let electron beams pass therethrough and strike another target at predetermined intervals; and means for synchronizing each electron beam to strike, at a predetermined time, a predetermined target comprising a predetermined focal spot thereon wherein at least one target comprises a cut-out section that allows electron beams to pass therethrough and strike another target at predetermined intervals.

2. The x-ray source of claim 1, wherein each target comprises a different focal spot thereon.

3. The x-ray source of claim 1, wherein each electron beam is focused at a different distance.

4. The x-ray source of claim 1, wherein each electron beam is aimed in a different direction.

5. The x-ray source of claim 1, wherein each electron beam strikes a different target having the appropriate focal spot thereon.

6. The x-ray source of claim 1, wherein the plurality of targets rotate about an axis of rotation.

7. The x-ray source of claim 1, wherein a single electron beam, focused at a predetermined distance, strikes only one target, comprising a matching predetermined focal spot thereon, at a time.

8. The x-ray source of claim 1, wherein adjusting an accelerating voltage placed on the electron gun accomplishes at least one of: focusing at least one electron beam, and changing electron beam properties.

9. The x-ray source of claim 1, wherein multi-slice images having a total thickness of up to about 160 mm can be obtained in a single gantry rotation.

10. The x-ray source of claim 1, further comprising:

a sensing device for identifying a rotational position of the targets.

11. The x-ray source of claim 10, wherein the sensing device comprises:

a magnetic material disposed on a rotor; and a magnetic pick-up device disposed in close proximity to the magnetic material; wherein, when the rotor spins around its axis of rotation, the magnetic pick-up device obtains a voltage or current signal as the magnetic material passes thereby, and then the magnetic pick-up device transmits an appropriately treated and amplified signal to the electron gun to do at least one of: change electron beam focusing parameters, and make deflection corrections.

12. The x-ray source of claim 1, wherein adjusting a focal bias voltage placed on the electron gun accomplishes at least one of: focusing at least one electron beam, and changing electron beam properties.

13. A method for obtaining thick multi-slice images in a single gantry rotation in computed tomography or volume computed tomography, the method comprising:

providing an electron gun for producing a plurality of electron beams, each electron beam focused at a predetermined distance and aimed in a predetermined direction;

providing a plurality of targets positioned to receive the electron beams and generate x-rays in response thereto, each target comprising a predetermined focal spot thereon, and at least one target configured to let electron beams pass therethrough and strike another target at predetermined intervals; and synchronizing each electron beam to strike, at a predetermined time, a predetermined target comprising a predetermined focal spot thereon wherein at least one target comprises a cut-out section that allows electron beams to pass therethrough and strike another target at predetermined intervals.

14. The method of claim 13, further comprising:

adjusting an accelerating voltage placed on the electron gun to accomplish at least one of: focusing at least one electron beam, and changing electron beam properties.

15. The method of claim 13, wherein multi-slice images having a total thickness of up to about 160 mm can be obtained in a single gantry rotation.

16. The method of claim 13, wherein each target comprises a different focal spot thereon.

17. The method of claim 13, wherein each electron beam is focused at a different distance.

18. The method of claim 13, wherein each electron beam is aimed in a different direction.

19. The method of claim 13, wherein each electron beam strikes a different target having the appropriate focal spot thereon.

20. The method of claim 13, wherein the plurality of targets rotate about an axis of rotation.

21. The method of claim 13, wherein a single electron beam, focused at a predetermined distance, strikes only one target, comprising a matching predetermined focal spot thereon, at a time.

22. The method of claim 13, further comprising:

providing a sensing device for identifying a rotational position of the targets.

23. The method of claim 22, wherein the sensing device comprises:

a magnetic material disposed on a rotor; and a magnetic pick-up device disposed in close proximity to the magnetic material, wherein, when the rotor spins around its axis of rotation, the magnetic pick-up device obtains a voltage or current signal as the magnetic material passes thereby, and then the magnetic pick-up device transmits an appropriately treated and amplified signal to the electron gun to do at least one of: change electron beam focusing parameters, and make deflection corrections.

24. The method of claim 13, further comprising:

adjusting a focal bias voltage placed on the electron gun to accomplish at least one of: focusing at least one electron beam, and changing electron beam properties.

25. A computed tomography or volume computed tomography imaging system, comprising:

an extended multi-spot x-ray source for computed tomography or volume computed tomography imaging, comprising:

an electron gun for producing a plurality of electron beams, each electron beam focused at a predetermined distance and aimed in a predetermined direction; and a plurality of targets positioned to receive the electron beams and generate x-rays in response thereto, each target comprising a predetermined focal spot thereon, and at least one target configured to let electron beams pass therethrough and strike another target at predetermined intervals;

means for synchronizing each electron beam to strike, at a predetermined time, a predetermined target comprising a predetermined focal spot thereon; and an x-ray detector, wherein the x-ray source projects a multi-spot beam of x-rays towards the x-ray detector, the x-ray detector detects the x-rays, and an image is created therefrom wherein at least one target comprises a cut-out section that allows electron beams to pass therethrough and strike another target at predetermined intervals.

* * * * *